US006508358B2

(12) United States Patent
Cheng

(10) Patent No.: US 6,508,358 B2
(45) Date of Patent: Jan. 21, 2003

(54) BASEBALL, SOFT BASEBALL AND LACROSSE BAG

(76) Inventor: Huei-Wen Cheng, No. 5, Lane 59, Tai Chang Erh Street, Taoyuan (TW)

( * ) Notice: Subject to any disclaimer, the term of this patent is extended or adjusted under 35 U.S.C. 154(b) by 0 days.

(21) Appl. No.: 09/827,238

(22) Filed: Apr. 6, 2001

(65) Prior Publication Data

US 2002/0144916 A1 Oct. 10, 2002

(51) Int. Cl.[7] ..... B65D 85/20
(52) U.S. Cl. ..... 206/315.1; 190/111; 190/112
(58) Field of Search ..... 206/315.1, 315.9; 190/109–114

(56) References Cited

U.S. PATENT DOCUMENTS 4,515,421 A * 5/1985 Steffes ..... 312/351
4,966,279 A * 10/1990 Pearcy ..... 190/100
5,356,004 A * 10/1994 Weinreb ..... 150/113
5,775,496 A * 7/1998 Cyr ..... 206/316.1

* cited by examiner

*Primary Examiner*—Shian Luong
(74) *Attorney, Agent, or Firm*—Troxell Law Office PLLC

(57) ABSTRACT

A bag dedicated for carrying baseball, soft baseball or lacrosse equipment essentially comprised of a bag and two detachable partitioning boards. An inner bag and a bottom pocket provided inside the bag. The inner bag has three zippers connected flap covers and two U-shape guide tracks to respectively receive the insertion of the partitioning board for segregating three compartments. Felt tapes are provided at both internal sides of the inner bag at where corresponding to positioning felt tapes provided at, the bottom of each partitioning board to reinforce the supporting strength of the partitioning board. The bottom pocket has a zipped opening at its front end. The bag allows respective accommodation of baseball, soft baseball or lacrosse equipment depending on the size and quantity of the object to achieve effective arrangement of accommodation space with improved lateral supporting strength from the partitioning boards and permits one-time carriage or transportation.

3 Claims, 5 Drawing Sheets

BASEBALL, SOFT BASEBALL AND LACROSSE BAG

BACKGROUND OF THE INVENTION (a) Field of the Invention

The present invention relates to a bag exclusively for carrying baseball, soft baseball and lacrosse equipment, and more particularly, to one that provides compartments for one-time carriage and transportation to the field.

(b) Description of the Prior Art

To facilitate carrying, various bags for baseball, soft baseball or lacrosse bag generally available in the market. Some are dedicated to pack up bat, ball, gloves, and others for hat, shoes, uniforms, glasses and other personal protection gears. It however creates problems that many bags of different types must be carried along.

A modified bag with larger storage space and partitions provided inside for separate storage options. Said partitions are removable for flexibility in use. Usually, each partition is attached to both sides of the inner bag using magic tape. However, said magic tape is vulnerable to be crashed or displaced due to the pressure created from the middle chamber with heavy loads. As a result, it fails to achieve the purpose of separating the space due to poor positioning of the partitions.

SUMMARY OF THE INVENTION

The primary purpose of the present invention is to provide a bag dedicated for carrying baseball, soft baseball or lacrosse equipment. The bag is provided in rectangular with extra length to provide multiple segregated compartments for optimal use to carry equipment depending on its nature so that all the equipment may be put in one bag for transportation.

Another purpose of the present invention is to provide a bag with reinforced lateral supporting strength to secure positioning of partitioning boards inside the bag. For positioning each partitioning board, a U-shape guide track is used to receive the vertically insertion of the partitioning board. The guide track is attachable to and detachable from the inner bag with adhesive felt provided on the bottom and both inner sides of the bag. Matching adhesive felts are also provided around the outer peripheral of the U-shape guide track so to improve the lateral supporting force of the partitioning boards for achieving duration and practical purposes at the same time.

DETAILED DESCRIPTION OF THE PREFERRED EMBODIMENTS

Figure 1:
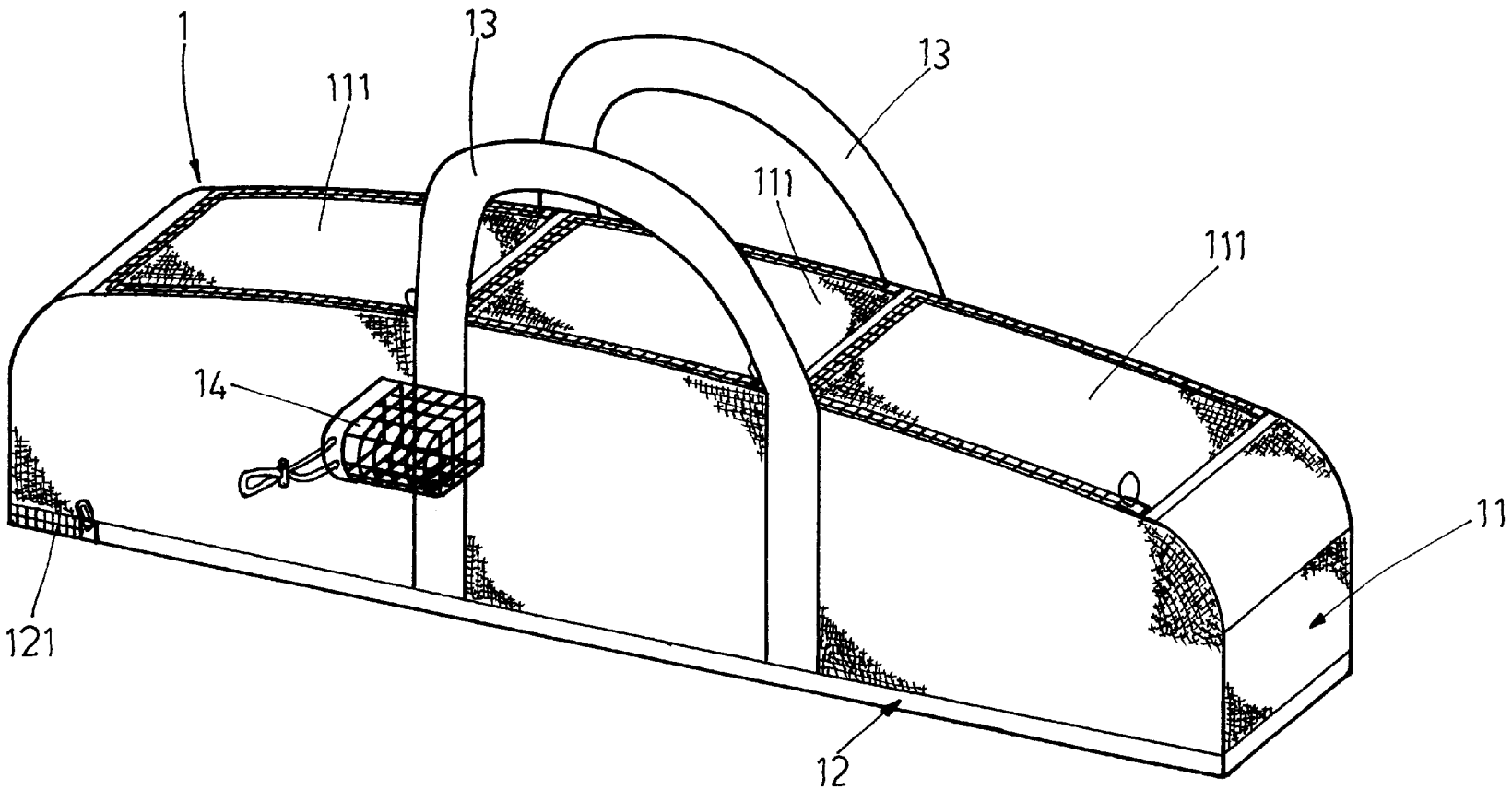
FIG. 1 is a schematic view showing a preferred embodiment of the present invention.
Figure 2:
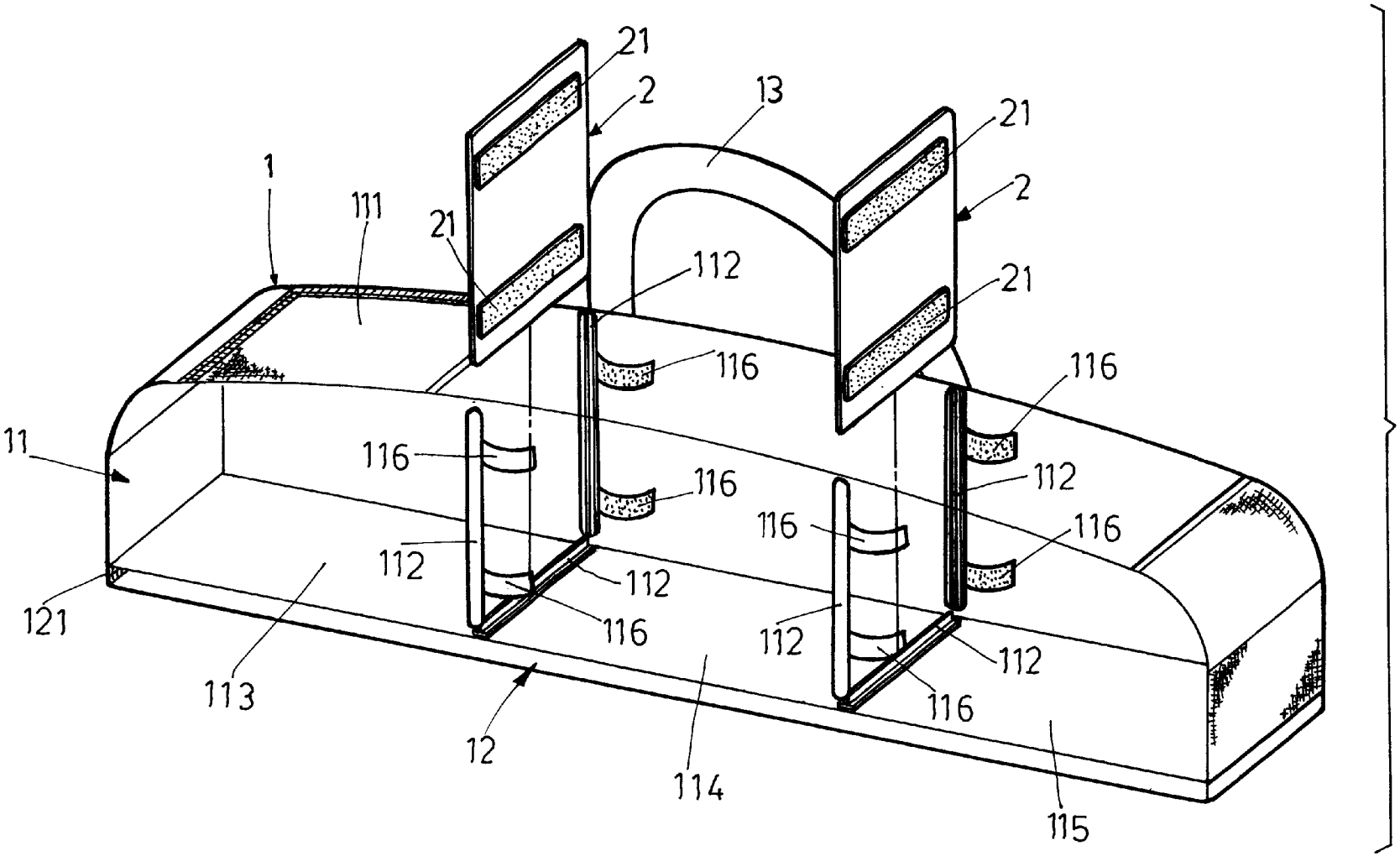
FIG. 2 is a schematic view showing the use of bag with partitioning boards installed inside the preferred embodiment of the present invention.
Figure 3:
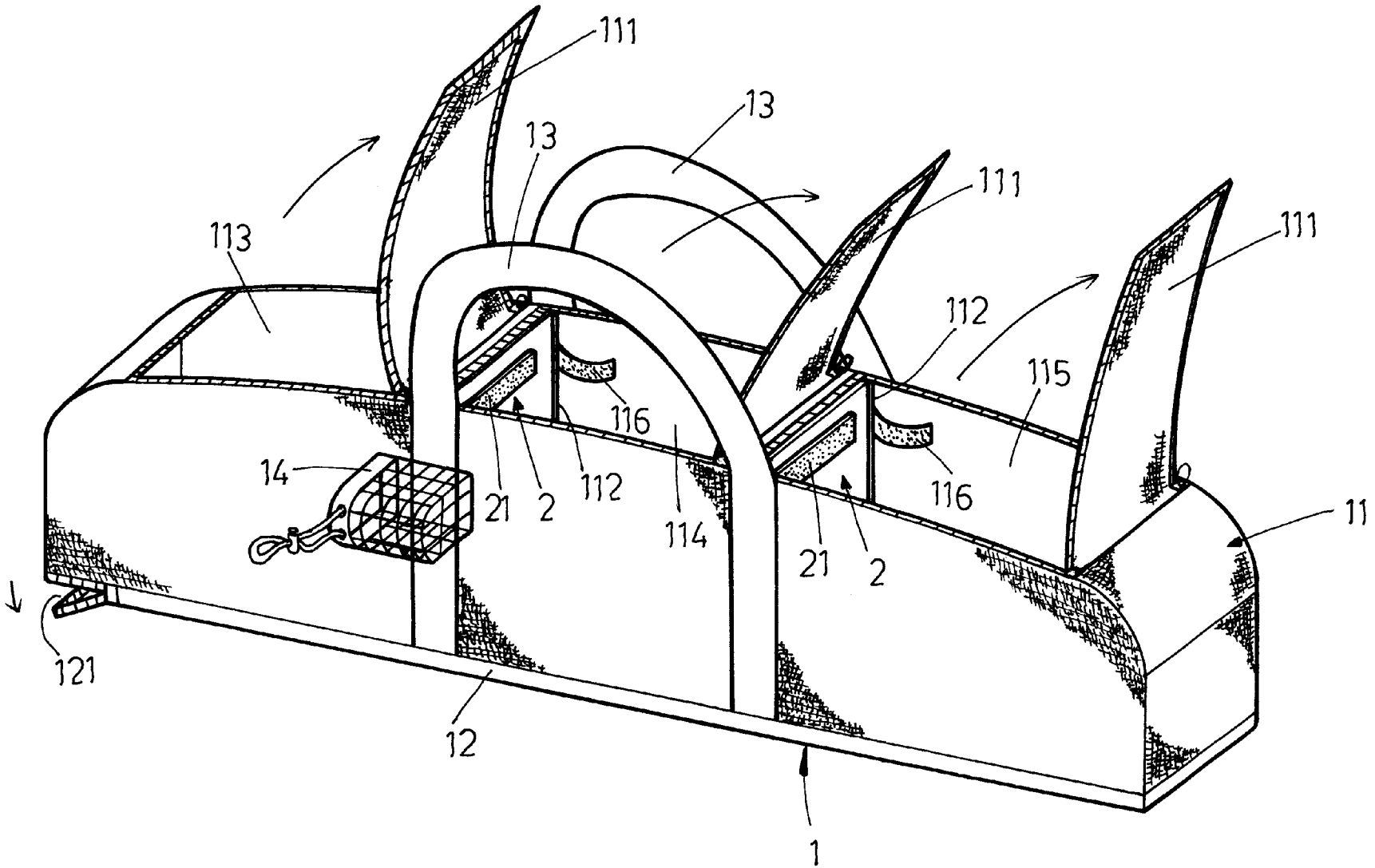
FIG. 3 is a schematic view showing the preferred embodiment of the present invention having each pockets opened up.
Figure 4:
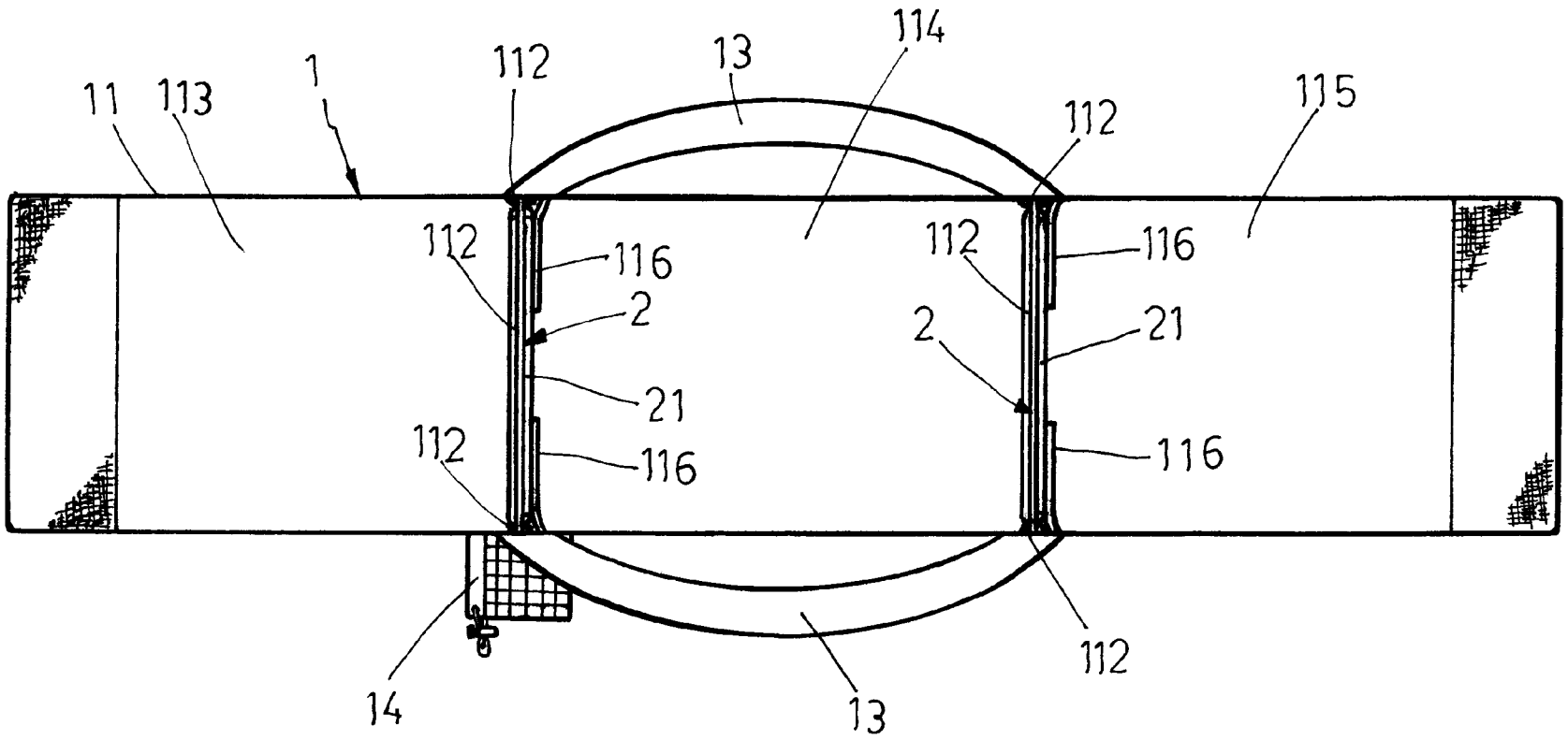
FIG. 4 is a schematic view showing that the preferred embodiment is supported by partitioning boards.

Referring to FIGS. 1 through 4, a preferred embodiment of the present invention for carrying baseball, soft baseball or lacrosse equipment is essentially comprised of a bag 1 made of flexible fabric and provided with an inner bag 11 and a bottom side pocket 12. The inner bag 11 has three pieces of flap covers each longitudinally provided and encloses a top pocket of the bag 1 by zippers. One U-shape guide track 112 is each provided at where three internal sides of the inner bag 11 join their corresponding two front flap covers 111 to respectively receive insertion of a partitioning board 2. By means of said partitioning boards 2 inserted inside the bag 1, three compartments respectively 113, 114 and 115 are created. Two units of positioning felt tapes 21 are provided at the bottom of each partitioning board 2. Both internal sides of the inner bag 11 are also provided with a similar felt tape 116 at where corresponding to that positioning felt tapes 21 at the bottom of the partitioning board 2. The adhesion of both felt tapes 21 and 116 provides better lateral supporting strength to the partitioning board 2 to prevent from being crashed or deformed due to extra pressure from the heavy load in the center of the bag 1. It also prevents the positioning board 2 from being displaced due to heavier pressure created at where both sides of the partitioning board 2 attached to the internal sides of the inner bag 11.

The bottom pocket 12 relates to an inner pocket in a depth crossing side to side of the bag 1. One end of the bottom pocket 12 is an opening 121 having a zipper to seal the compartment formed inside the bottom pocket 12.

Now referring to FIG. 1, a pair of handles 13 is provided to both external sides of the bag 1 to facilitate carrying or transportation of the entire bag 1. An additional mesh bag 14 may be attached to either side of the bag 1 as applicable.

Figure 5:
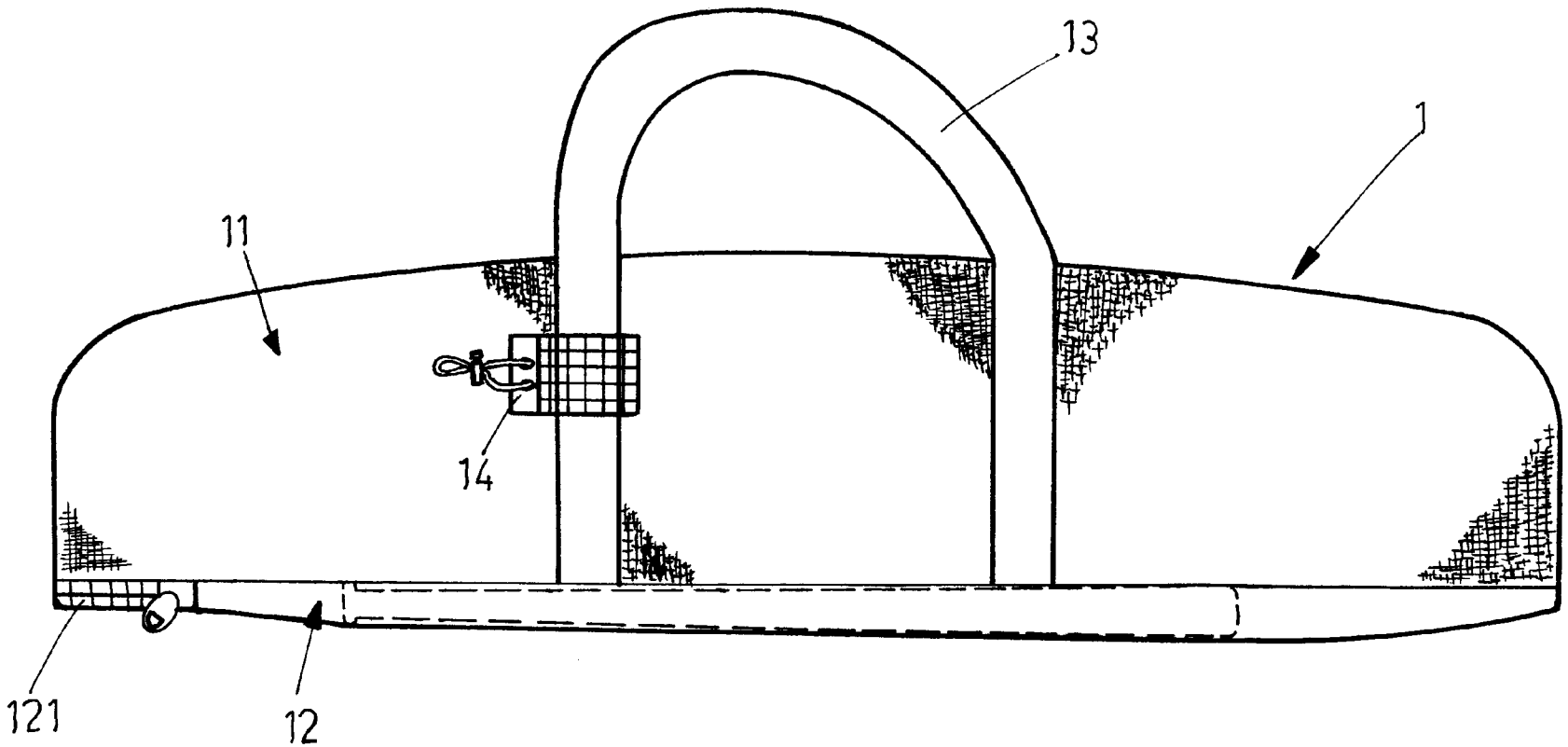
FIG. 5 is a schematic view showing another preferred embodiment of the present invention provided at its bottom a side pocket for carrying a bat.

In the present invention as disclosed above, a means comprised of the insertion of two partitioning boards 2 to from three compartments 113, 114 and 115 for placing into baseball, soft baseball or lacrosse equipment. Said partitioning board 2 is detachable to allow the option of installing one or two said partitioning board 2 depending on the size and quantity of the equipment. The felt tape 21 provided at the bottom of the partitioning board 2 when fastened to the corresponding felt tape 116 inside the inner bag 11 gives better lateral supporting strength to secure the accommodation space in the bag without compromising its practicability. Furthermore, the bottom pocket 12 as disclosed in FIG. 5 allows accommodate a bat and its opening 121 can be sealed up with the zipper. The present invention permits effective and practical segregated accommodation space to carry or to transport baseball, soft baseball or lacrosse equipment in one bag. Therefore a utility application is filed accordingly.

What is claimed is:

1. A bag exclusively for carrying baseball, soft baseball or lacrosse equipment comprised of:

an inner surface and a bottom pocket made of flexible fabric;

three flap covers provided longitudinally on the bag and connected one another with zippers;

the bottom pocket crossing from side to side of the inner surface with a front end opening sealed with a zipper; and two U-shape guide tracks provided inside the bag; and, two partitioning boards located in the U-shape guide tracks to create three compartments inside the bag.

2. The bag exclusively for carrying baseball, soft baseball or lacrosse equipment as claimed in claim 1 further comprising two positioning felt tapes provided at a bottom of each partitioning board.

3. The bag exclusively for carrying baseball, soft baseball or lacrosse equipment as claimed in claim 2 further comprising felt tapes provided on internal sides of the inner surface corresponding to the positioning felt tapes provided at the bottom of each partitioning board to provide lateral supporting strength to the partitioning boards.

* * * * *